United States Patent [19]

Zecman

[11] Patent Number: 4,623,015

[45] Date of Patent: Nov. 18, 1986

[54] SHOT SLEEVE

[76] Inventor: Kenneth P. Zecman, P.O. Box 39009, Redford, Mich. 48239

[21] Appl. No.: 678,245

[22] Filed: Dec. 5, 1984

[51] Int. Cl.[4] ..... B22D 17/10

[52] U.S. Cl. ..... 164/312; 164/303

[58] Field of Search ..... 164/312, 313, 314, 315, 164/316, 317, 318, 412, 303, 304, 305

[56] References Cited

U.S. PATENT DOCUMENTS 3,515,203 6/1970 Parlanti et al. ..... 164/312

3,533,464 10/1970 Parlanti et al. ..... 164/312

FOREIGN PATENT DOCUMENTS 53-131231 11/1978 Japan ..... 164/303

*Primary Examiner*—Nicholas P. Godici

*Assistant Examiner*—Richard K. Seidel

*Attorney, Agent, or Firm*—Krass & Young

[57] ABSTRACT

An improved shot sleeve for molding molten metals has a surface pattern of copper for passively distributing heat from a well opening in the sleeve side wall. Molten metal is poured into the well and is discharged along the internal sleeve bore and longitudinally out from the sleeve into a die means by a water-cooled piston. The improvement involves a surface pattern of copper to produce lower operating temperatures by conducting and radiating heat away from the well. The benefits are longer plunger life and longer sleeve life.

4 Claims, 2 Drawing Figures

SHOT SLEEVE

TECHNICAL FIELD

The present invention relates to apparatus for molding molten metals and, more particularly, to an improved shot sleeve.

BACKGROUND OF THE INVENTION

A shot sleeve is a device for injecting molten metal into a die or mold. Relatively simple in construction, it typically comprises a metal cylinder defining an axial chamber and a piston fitted within the chamber to act as an injection ram. An aperture in the side of the sleeve opens into a portion of the cylinder chamber just in front of the piston when it is in the rest position. This portion of the chamber is called the "well" and the molten metal is poured into the well for temporary residence before the piston is actuated.

Because of the high temperature difference between the molten casting metal and the elements of the shot sleeve, useful life expectancy of prior art devices is quite short. This is believed to be due in part to warpage and erosion of the axial chamber, and resulting piston wear.

Efforts have been made to increase useful life by water cooling the tip of the piston; i.e., the end whose face contacts the molten metal. It is theoretically possible to water cool the sleeve itself in the area of the well but both expense and the danger of ultimately leaking coolant into the well itself tend to discount the practicality of this approach.

SUMMARY OF THE INVENTION

The principal objectives of the present invention are to increase the useful life of a shot sleeve without adding substantial cost to the construction and operation of same, thereby to reduce the frequency of piston tip replacement and the cumulative length of down time due to casting equipment failure.

In general, this is accomplished by adding to a conventional, axial-bore, piston-operated shot sleeve a surface pattern of high thermal conductivity material, such as copper, which intercepts the well area and extends toward the casting die mount so as to passively transfer heat from the well to larger components which act as a heat sink.

The invention is preferably used in conjunction with a shot sleeve of the type having a water-cooled piston.

DESCRIPTION OF THE PREFERRED EMBODIMENTS

Figure 1:
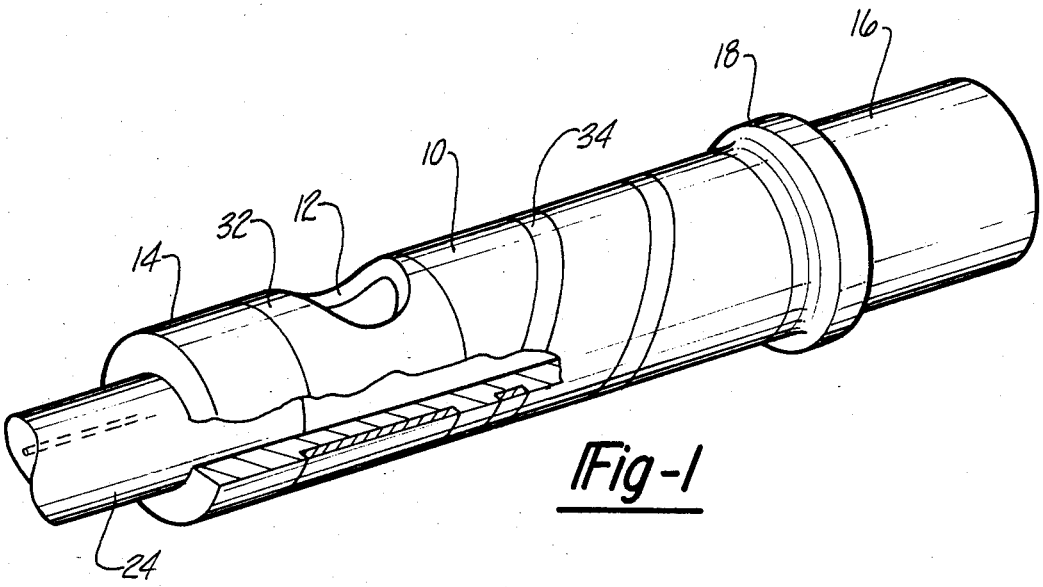
FIG. 1 is a perspective view of the shot sleeve apparatus of the present invention.
Figure 2:
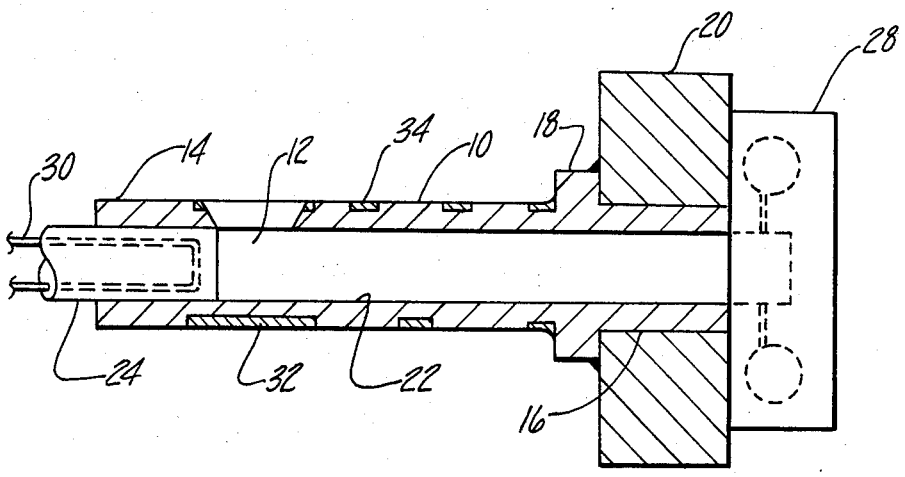
FIG. 2 is a longitudinal section view of a preferred embodiment of the shot sleeve apparatus.

Referring now to the drawing, the shot sleeve of the present invention includes a hollow, substantially cylindrical body 10 having a side opening well 12 mediate a piston end 14 and an injection end 16 fitted, in this case, with a mounting collar 18 which abuts a casting machine platen 20 when installed. Sleeve 10 is bored through to form an axial passage 22 which receives a water cooled piston 24. Well 12 is adjacent the face of piston 24 in its rest position as shown in FIG. 2. After molten metal is poured into the well 12, the piston 24 is actuated by suitable means to displace the molten metal longitudinally through the bore 22 and into the casting die 28 in a conventional fashion.

In actual practice, molten metal is poured from a ladle into well 12. The well opening may be circular or oval.

The temperature of molten metal should be sufficiently high above the freezing point as to minimize the chance of premature freezing during the die casting operation. On the other hand, the temperature of molten metal in the ladle should not be excessively high, otherwise unnecessary contraction will occur during the liquid cooling and resultant solidification process. For example, in the case of molten aluminum, the temperature of the melt should be about 1250° F.

Having been introduced into the shot sleeve 10 through well 12, the molten metal will then radiantly, convectively, and conductively dissipate a high amount of thermal energy. Unless such dissipation occurs in a controlled manner, frequent and expensive replacement of the piston 24 is necessary. Down time in repairing the shot sleeve piston is expensive as capital equipment and manpower stands idle.

Heat is carried away from the piston tip by means of a circulating coolant path 30, which extends from a pump and coolant source, not shown, through the piston 24 and back to the source through a heat exchanger in conventional fashion.

In accordance with the invention, additional heat is passively carried away from the well 12 by means of a shallow surface pattern of copper of other material having high thermal conductivity which extends from a band 32 which intercepts the well 12 and thence by a spiral 34 to the base of the mounting collar 18. The surface pattern 32,34 passively dissipates heat along the outside surface of the shot sleeve body 10 toward the mounting collar 18 and the die cast machine platen 20. In actual practice, the surface pattern of copper is welded into a groove machined into the outside surface of shot sleeve body 10, and its thickness or depth is about 0.07 inches.

In actual practice, the inside diameter of chamber 22 may vary from 2.00 inches to 5.50 inches, with most commercial embodiments having an internal diameter within the range of 2.00 inches to 3.50 inches. The fabrication of shot sleeve body 10 to which the subject invention may be applied will vary in accordance with the particular requirements of the application. Preferably, the shot sleeve 10 is finish-machined and nitrided to exacting specifications. The steel is prehardened, with a nitrided case hardness of 55 to 60 Rc, which gradually decreases, although not abruptly.

My invention as described includes a pattern of copper to convey thermal energy away from the well area. This allows the internal diameter of chamber 22 to be so specified as to provide a tight fit with piston 24, thus minimizing seepage of molten metal caused by back pressure along the space between the piston 24 and the walls of bore 22. The aforementioned heat dissipating means has the attribute of reducing the frequency with which the copper beryllium tips of pistons 24 need to be replaced; i.e., by reducing the ambient temperature or operating temperature of the sleeve via the copper one expects longer useable life from the shot sleeve. It is important to understand that the sleeve is heated solely from the molten metal. Because the molten metal spends a disproportionate time in the well area, this part of the sleeve becomes many degrees hotter. This hot area in the sleeve (well) is due to the fact that steel cannot transfer the heat away efficiently enough.

Copper has ten times the conductivity of steel and, therefore the efficiency in heat transfer that is necessary to equalize temperature and maintain size stability of the I.D. bore.

It is believed that the improved shot sleeve apparatus and method of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. In a shot sleeve assembly of the type which comprises a metal body of first thermal conductivity having first and second ends, an axial bore extending between said ends, a radial bore defining a well mediate said ends and including a portion of said axial bore, and a piston disposed within said axial bore and reciprocal relative to said body for displacing molten metal from said well toward said second end, the improvement wherein;

a narrow elongated strip formed of a material having a second thermal conductivity substantially greater than said first thermal conductivity extends over the outer surface of said body from a location proximate said well to the vicinity of said second end for passively conveying heat away from said well, said assembly further comprising a band formed of said second thermal conductivity material positioned around said body and intercepting said well, said strip extending in a spiral pattern from said band axially along and around said outer surface from said well to said second end.

2. A shot sleeve assembly according to claim 1 wherein said strip and said band are formed of copper and are fused to said shot sleeve.

3. A shot sleeve assembly for moving molten metal into a mold cavity, said assembly comprising:

an elongated shot sleeve having a bore extending axially therethrough from a first end, to a second end adapted to be positioned adjacent the mold cavity, said sleeve formed of a first metal having high strength and a relatively low heat conductivity;

a well opening extending through the side wall of said sleeve at a location adjacent said first end;

an injector piston slidably mounted in said bore adjacent said first end; and a narrow elongated strip formed of a second metal having a relatively high heat conductivity extending over the outer surface of said sleeve from a location adjacent said well opening to a location adjacent said second end for passively conducting thermal energy away from said well opening and toward said second end, said assembly further comprising a band formed of said second metal positioned around said sleeve and intercepting said well opening and wherein said strip extends in spiral form from said band axially along and around the outer surface of said sleeve to said second end.

4. A shot sleeve assembly according to claim 6 wherein said strip is fused into a groove of finite depth formed in the outer surface of said sleeve.

* * * * *